United States Patent [19]

Kamstra et al.

[11] 4,143,638

[45] Mar. 13, 1979

[54] FIREPLACE HEAT EXCHANGE SYSTEM

[76] Inventors: Gordon E. Kamstra, 4555 E. Paris SE., Grand Rapids, Mich. 49508; Robert J. Powers, 5225 76th St., SE., Caledonia, Mich. 49316

[21] Appl. No.: 799,597

[22] Filed: May 23, 1977

[51] Int. Cl.[2] ..... F24B 7/00

[52] U.S. Cl. ..... 126/121; 122/20 B; 237/51; 432/223; 165/DIG. 2

[58] Field of Search ..... 126/120, 121; 432/223; 165/DIG. 2; 122/20 B; 237/51

[56] References Cited

U.S. PATENT DOCUMENTS

| | | | |
|---|---|---|---|
| 2,158,041 | 5/1939 | Covert | 237/51 |
| 2,283,427 | 5/1942 | Disotell | 126/121 |
| 2,671,440 | 3/1954 | Dupler | 126/121 |
| 2,707,946 | 5/1955 | Merryweather et al. | 125/140 |
| 2,789,554 | 4/1957 | Dupler | 126/63 |
| 2,814,287 | 11/1957 | Shults | 126/140 |
| 2,832 332 | 4/1958 | Johnson | 126/121 |
| 2,869,787 | 1/1961 | Dupler | 126/92 |
| 3,749,078 | 7/1973 | Dupler | 126/121 |
| 3,829,285 | 8/1974 | Beck | 432/223 |
| 3,834,619 | 9/1974 | Glover | 126/121 |
| 3,888,231 | 6/1975 | Galluzzo et al. | 126/120 |
| 4,026,263 | 5/1977 | Boyd | 126/121 |
| 4,042,160 | 8/1977 | Ickes | 126/121 |
| 4,049,194 | 9/1977 | Tice et al. | 126/121 |
| 4,055,297 | 10/1977 | Lee | 237/51 |

*Primary Examiner*—Ronald C. Capossela

*Attorney, Agent, or Firm*—Price, Heneveld, Huizenga & Cooper

[57] ABSTRACT

A fireplace heat exchange system is disclosed which is connectable to an existing forced air heating system of a building. The heat exchange unit includes a housing or enclosure within which is disposed a firebox. The enclosure and the firebox define a heat exchange space. The firebox includes a front opening which is closed by doors. A plenum is positioned on top of the firebox for collecting combustion gases. A plurality of heat exchange fins are secured to the exterior of the firebox within the heat exchange space to channel the incoming air entering the housing around and over the firebox and to increase the efficiency and rate of heat exchange. An air control device is positioned adjacent the front of the firebox to control the amount of combustion air entering the firebox. A chimney connects to the plenum and a chimney damper limits the combustion gas flowing out the chimney.

13 Claims, 10 Drawing Figures

FIREPLACE HEAT EXCHANGE SYSTEM

BACKGROUND OF THE INVENTION

This invention relates to heating systems of the forced air type and more particularly to a fireplace type heat exchange unit adapted for connection into the ducts of a forced air heating system.

Conventional fireplaces having an open hearth are extremely inefficient sources of heat for the room or building within which they are located. Typically, up to 90% of the heat generated by the burning material in the fireplace is lost up the chimney. Only 10% of the heat generated by the burning material radiates out of the fireplace to heat the room. Further, such open hearth fireplaces create a draft which in fact will cool down other rooms in the house as air is drawn or infiltrates from the exterior of the house and from the other rooms to the fireplace to support combustion. With such conventional fireplaces, drafts of 100–250 CFM are typical. This flow of air passing into the open fireplace and up the chimney is substantially more than is required to support combustion.

Various proposals have been made to increase the efficiency of fireplaces so that they may supplement the existing home heating systems or to at least reduce the negative effect of a fireplace on the overall efficiency of the home heating system. For example, it has been proposed to close the fireplace opening with high temperature, heat resistance glass doors. Such doors reduce the amount of heat loss up the chimney. These doors, however, alone do not substantially increase the overall heating efficiency of the fireplace.

With systems designed to supplement existing heating systems, a firebox is typically placed within a steel enclosure or within a fire brick or masonry enclosure so as to define with the enclosure a heat exchange space. Cold air inlets are provided at the floor level adjacent the fireplace and hot air outlets are positioned above and/or to the sides of the fireplace. The combustion gases within the firebox will heat the enclosure and the firebox. Natural convection draws cold air into the inlets through the enclosure, past the firebox, out the outlets and into the room within which the fireplace is placed. Although increasing the heating efficiency when compared to conventional fireplaces, such arrangements are incapable of heating the entire home or building within which the fireplace is located. Examples of such prior fireplace type heat exchange systems may be found in U.S. Pat. No. 1,670,034 to Halberg, entitled FIREPLACE and issued on May 15, 1928; U.S. Pat. No. 3,965,886 to Nelson entitled HOME FIREPLACE HEATING and issued on June 29, 1976; and U.S. Pat. No. 3,998,203 to Jensen entitled AIR HEATER FOR FIREPLACES and issued on Dec. 21, 1976.

In an attempt to increase the overall heating efficiency of fireplace units and to provide heat to rooms other than the room within which the fireplace is located, it has been proposed to position the fireplace heat exchange unit in line with the cold air return ducts or in line with the hot air distribution ducts of a conventional heating system. Examples of these forms of home heating systems including such supplemental fireplace heat exchangers may be found in U.S. Pat. No. 2,186,539 to Slayter et al, entitled HEATING SYSTEM and issued on Jan. 9, 1940; U.S. Pat. No. 2,191,064 to Wagner, entitled HEATING APPARATUS, and issued on Feb. 20, 1940; U.S. Pat. No. 2,231,258 to Elmore entitled HEATING SYSTEM and issued on Feb. 11, 1941; U.S. Pat. No. 2,333,146 to Beyer, entitled HEATING AND VENTILATING FIREPLACE SYSTEM, and issued on Nov. 2, 1943; and U.S. Pat. No. 4,004,731 to Zong, entitled DEVICE FOR TRANSFERRING HEAT ENERGY FROM A FIREPLACE TO A FLUID HEATING SYSTEM and issued on Jan. 25, 1977.

Although systems of the type disclosed in the aforementioned U.S. Patents do increase the heating efficiency of fireplaces and do circulate some of the heat which is typically lost up the chimney, these systems are incapable of providing sufficient heat to serve as the sole means for heating average size dwellings within which they may be located.

SUMMARY OF THE INVENTION

A need therefore exists for a unique fireplace type heat exchange system which is connectable to the distribution or return ducts of a forced air heating system and which is capable of heating the air passing through the forced air system to temperatures sufficient to adequately heat the average size dwelling. In accordance with the present invention, a unique fireplace heat exchanger or heating unit is provided whereby substantial increases in heat transfer efficiency are obtained when compared with prior devices.

Essentially, the heat exchange unit includes a firebox positioned within a housing or enclosure so as to define therewith a heat transfer space. The front opening of the firebox is closed by closure means to eliminate smoking and to close off the normal draft to the firebox. The enclosure seals around the firebox and the firebox is provided with a plurality of heat exchange fin means positioned thereon to channel and guide the air entering the enclosure from the forced air system over and around and under the firebox resulting in highly efficient transfer of heat from the hot combustion gases and the hot firebox to the forced air. A combustion air control means is positioned on the front of the unit to reduce the amount of combustion air entering the firebox to a level sufficient to support combustion. Damper means are positioned in the chimney connected to the top of the firebox at the smoke dome to control and limit the rate at which the hot combustion gases escape through the chimney. A plenum means is positioned between the damper and the firebox to collect the hot combustion gases thereby further increasing the heat transfer efficiency.

A fireplace heat exchange system in accordance with the present invention is capable of increasing flue stack temperatures from the typical 250° F. to temperatures in the range of 600–700° F. The combustion air entering the firebox is reduced from the typical range of 100–250 CFM to the range of 10–25 CFM which is sufficient to support combustion of the wood or other material positioned within the firebox.

DETAILED DESCRIPTION OF THE PREFERRED EMBODIMENT

Figure 1:
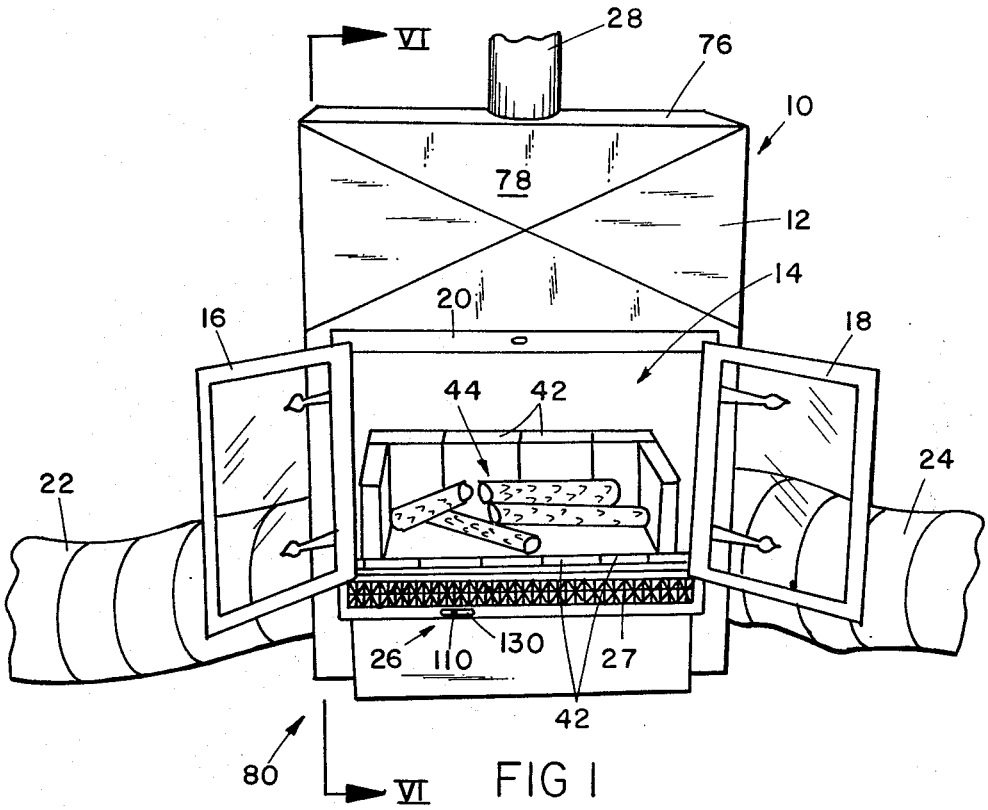
FIG. 1 is a front, elevational view of a fireplace heating unit in accordance with the present invention.
Figure 2:
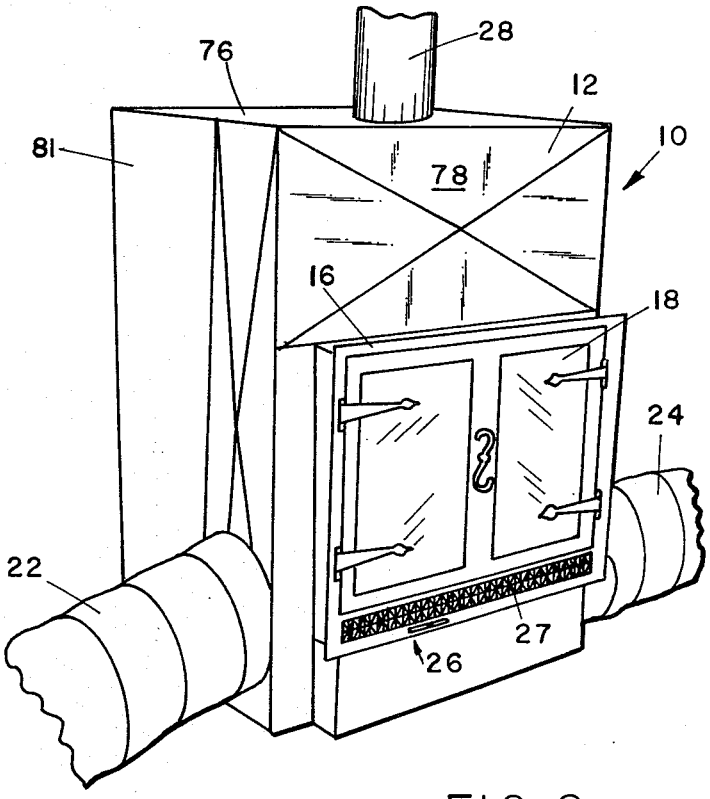
FIG. 2 is a perspective view of the fireplace heat exchange unit of FIG. 1.
Figure 3:
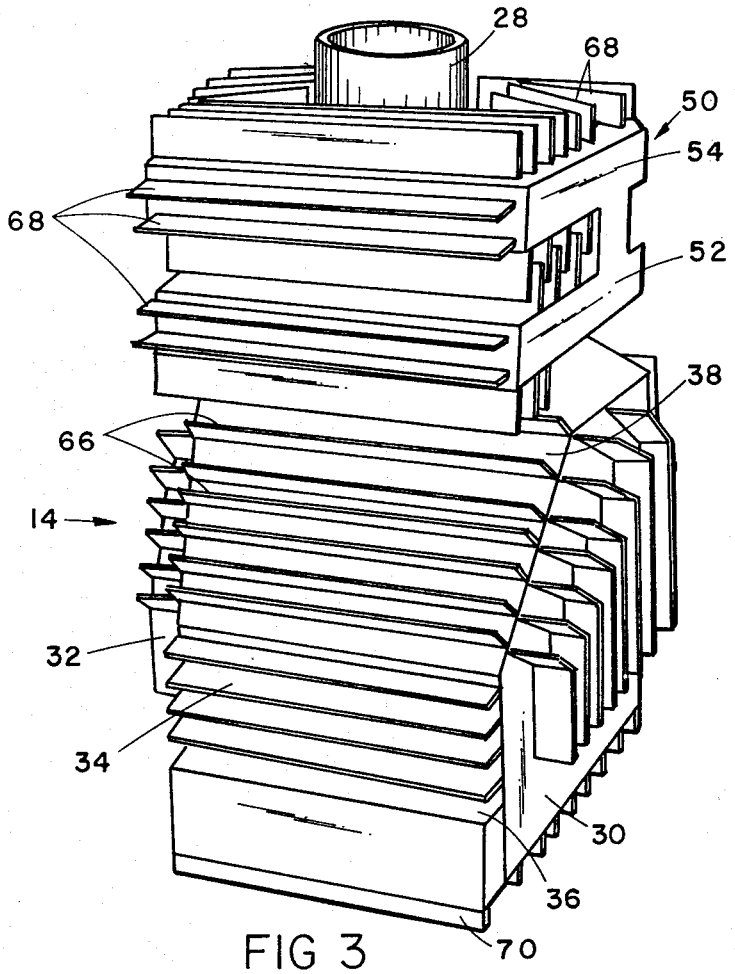
FIG. 3 is a rear, perspective, elevational view of a firebox employed with the heat exchange unit in accordance with the present invention.
Figure 5:
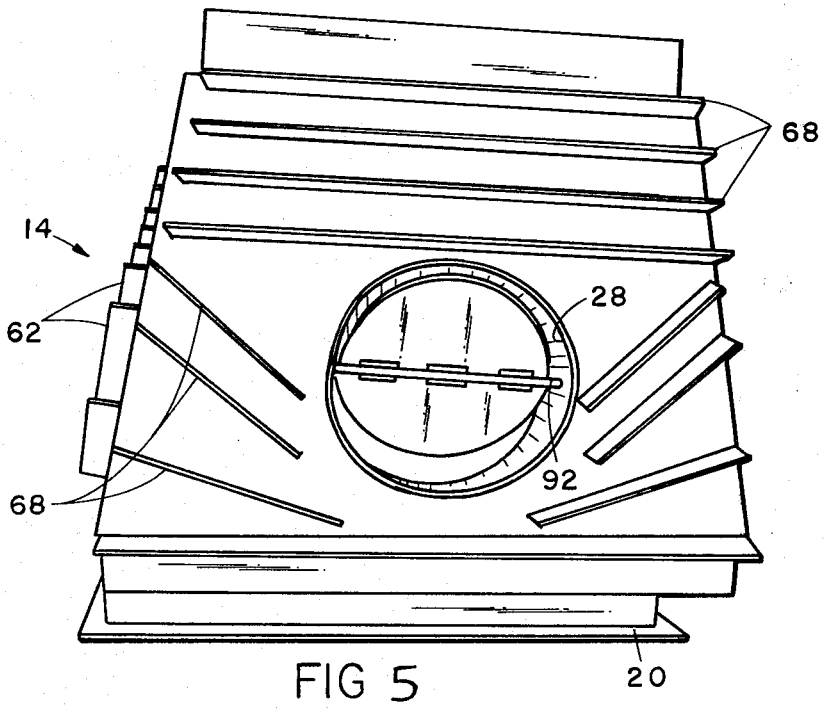
FIG. 5 is a top, perspective view of the firebox of FIG. 3.
Figure 4:
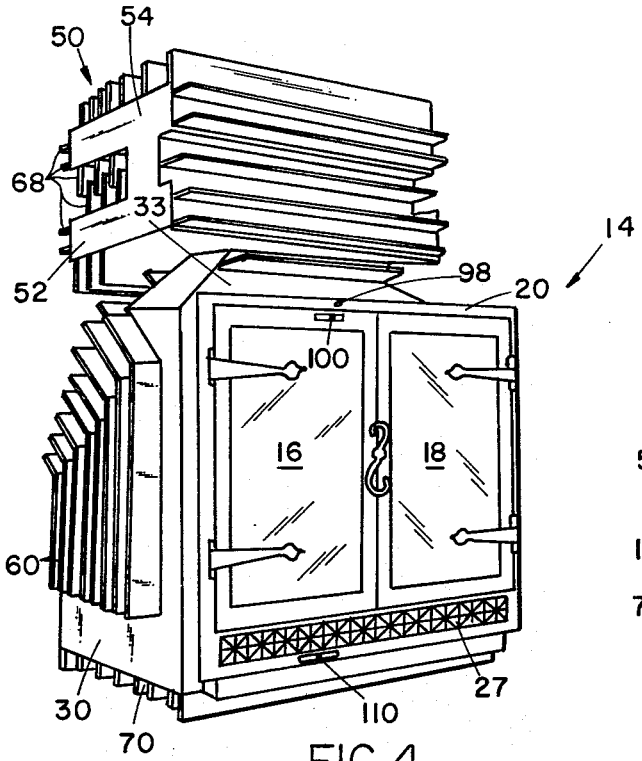
FIG. 4 is a front, perspective view of the firebox of FIG. 3.
Figure 6:
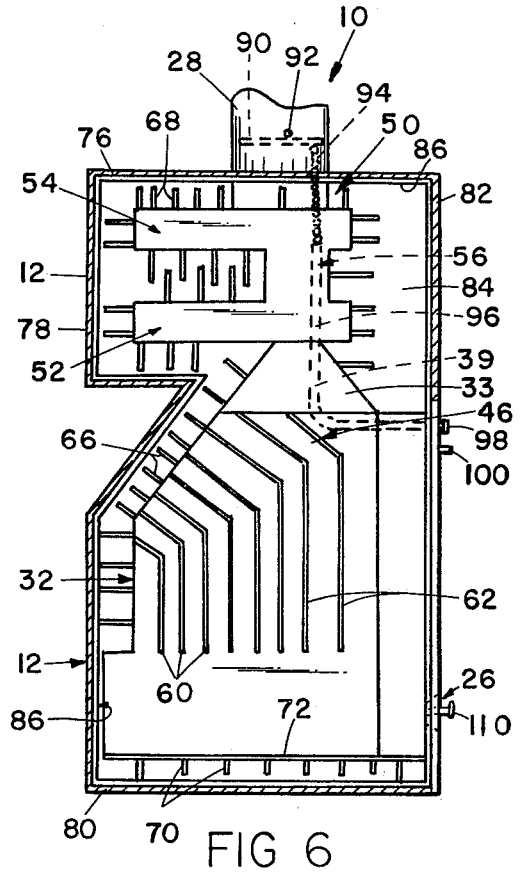
FIG. 6 is a side, elevational view in cross section taken generally along line VI—VI of FIG. 1.

A preferred embodiment of the unique fireplace heating unit in accordance with the present invention is illustrated in the drawings and generally designated 10. As seen in FIGS. 1, 2 and 6, the heat exchange unit 10 includes the steel enclosure or housing 12 within which is positioned a fabricated, steel firebox 14 having a front opening. The front of the firebox 14 is preferably closed by tempered, high temperature glass doors 16, 18 hingedly mounted on a frame 20. The enclosure 12 is connected into an existing heat exchange system, as more fully described below, through an inlet duct 22 and an outlet duct 24. A combustion air control means 26 is mounted at the front of the unit adjacent the doors 16, 18 and behind a grill 27. The air control means provides control over the amount of combustion air entering the firebox 14. A chimney or duct 28 connectable to a chimney extends through the top wall of the housing to the firebox.

As seen in FIGS. 3–6, the firebox 14, which is preferably fabricated from heavy gauge steel, includes sidewalls 30, 32, a front wall 33 and a rear wall 34 having a lower vertical portion 36 and an upper forwardly angled tapered portion 38. The sidewalls may be angled inwardly from the front of the firebox to the rear thereof. The sidewalls 30, 32 and the rear wall 34 define a grate area as seen in FIG. 1 where material such as wood may be burned. As shown in FIG. 1, the grate area is preferably lined with refractory material such as fire brick 42 and upon which combustibles such as wood 44 may be directly placed or upon which a grate may be positioned to support the firewood. A grate may be provided to raise the material off the fire brick and also to permit the passage of combustion air from below, up and around the combustible material.

As seen in FIG. 6, the rear wall 32 of the firebox and the front and sidewalls define a tapered smoke dome area 46 of decreasing cross-sectional area. In a typical firebox or fireplace, the chimney or flue 28 would be connected to the firebox directly at the smoke dome area 46. However, with the firebox in accordance with the present invention a plenum 50 is provided on top of the firebox and the chimney 28 is connected to the plenum 50. The plenum 50 is preferably fabricated from heavy gauge sheet steel and defines a first plenum, collector chamber or portion 52 which communicates directly with the firebox through the smoke dome area 46. Positioned above and superimposed with the first chamber 52 is a second plenum collector chamber or portion 54. The two portions of the plenum are interconnected by a transfer duct or tube portion 56. The transfer duct has a horizontal cross-sectional area less than that of either portion 52 or 54 and intersects these portions intermediate their front and rear vertical ends. The plenum 50 collects combustion gases passing from the firebox to the chimney, increases the heat exchange surface area and causes substantial increases in the flue temperatures to thereby greatly increase the heat exchange rates. The number of chambers defined by the plenum may be varied to suit the particular application. By adding portions, additional collection zones or chambers would be provided. This would increase the amount of heat transferred so that larger dwellings could be heated. With some buildings, a single chamber may be adequate.

In order to further increase the efficiency of the unit, a plurality of heat exchange fins are welded or otherwise suitably secured to the exterior surfaces of the firebox. The sidewalls 30, 32 are provided with a plurality of heat exchange fins 60, each of which includes a vertically extending portion 62 and an angled portion 64. The heat exchange fins 60 are positioned in parallel relationship and extend from a point near the bottom of the firebox upwardly to the tapered wall portions of the firebox. Positioned on the rear wall 32 of the firebox are a plurality of horizontal heat exchange fins 66. Heat exchange fins 66 extend in spaced parallel relationship transversely of the rear wall 32. The plenum 50 is also provided with a plurality of heat exchange fins 68. The heat exchange fins 68 extend transversely of the plenum 50 around both chamber defining means 52 and 54 and along at least one side of the transfer tube 56. Also, as best seen in FIG. 6, a plurality of heat exchange fins 70 extend transversely of the bottom wall 72 of the firebox.

The enclosure 12 includes a top wall 76, a back wall 78, a bottom defining portion 80, sidewalls 81 and a front wall 82. It is preferred that the enclosure 12 be fabricated from steel sheet metal and that it surround the firebox and effectively seal the area around the firebox. The enclosure housing 12 therefore defines with the firebox a heat exchange space 84. It is preferred that the inner surfaces of the walls of the enclosure be spaced from the firebox itself so as to allow for sufficient air passage. A distance of approximately 6 inches from the firebox walls and a distance of approximately 3 inches from the free ends of the heat exchange fins have been found to be adequate. Further, it is preferred that the inner surface of the enclosure or housing 12 be covered with an insulating material 86 to reduce the heat losses through the enclosure. The insulation 86 may be covered by a reflective material to further reduce heat losses. The bottom defining portion 80 encloses the heat exchange fins 70 and permits air to pass in heat exchange relationship with the fins and the bottom wall 72 of the firebox.

Air entering the enclosure 12 through the inlet duct 20 will be directed, guided or channeled by the heat exchange fins 60, 66, 68 and 70 so as to pass over, around and under the firebox and the plenum 50. The heat exchange fins increase the heat exchange surface area substantially from that heretofore provided in conventional fireplace heat exchange units.

Eccentrically pivoted within the chimney 28 at the base thereof is a damper illustrated in the form of a disc 90. The disc 90 is pivotally supported on a rod or pivot pin 92. The positioning of the disc 90 is manually controlled through a chain 94 connected at one end to the disc 90 and at its other end to a knob or handle 98. The chain 94 extends down the chimney 28 through the plenum 50, into the smoke dome area 46 of the firebox and out the front of the frame 20 adjacent the closure doors 16, 18 through tubing or pipe 96. Further, a slotted bracket 100 is provided on the front face of the unit so that the chain 94 may be slipped through the slot formed in the bracket to thereby hold the disc open. It is presently preferred that the disc 90 be dimensioned so that when it is positioned transversely of the chimney 28 or in the closed position, approximately 10% of the horizontal cross-sectional area of the chimney is left open. This prevents closing of the chimney if combustible material is still burning within the firebox. Further, by eccentrically pivoting the disc 90, should the chain 94 break, the damper will pivot to a vertical position extending longitudinally of the chimney 28.

Figure 8:
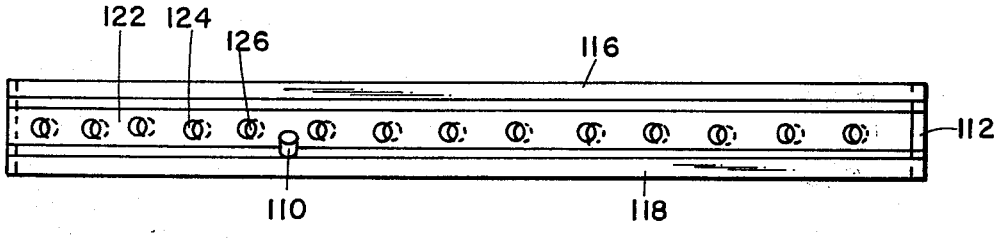
FIG. 8 is a front, elevational view of an air control means incorporated in the present invention.
Figure 9:
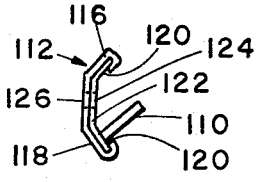
FIG. 9 is a left side, elevational view of the air control means of FIG. 8.

The combustion air control means 26 supported within the frame 20 below the hearth opening, includes a knob 110 which permits manual adjustment of the amount of air entering the firebox. As best seen in FIGS. 8 and 9, the combustion air control means includes front and rear sliding plates. The rear plate 112 includes a central portion 114 and upper and lower forwardly angled portions 116, 118 respectively. The lateral edges of the upper and lower portions 116, 118 are bent in a general U-shape to define guide tracks 120 within which the outer plate 122 is slidably positioned. As seen in FIG. 8, the outer plate 122 is provided with a plurality of equally spaced apertures 124. Also, the rear plate 112 is provided with a plurality of equally spaced apertures 126. The apertures 124 and 126 are spaced equal intervals along each of the plates and the plates have the same longitudinal dimensions. The knob 110 extends through a slot 130 formed in the lower portion of frame 20. The plate 122 need be shifted only through a distance equal to the diameter of the apertures 124, 126. As should be readily apparent from FIG. 8, shifting of the plate 122 varies the area through which combustion air may enter from zero up to the maximum provided by the areas of each of the apertures 124, 126. Under normal heating situations, the damper 90 and the combustion air control means 26 will be adjusted so that the draft into the firebox will be on the order of 10–25 CFM. The combustion air inlet air need only be sufficient to support combustion of the material burning within the firebox.

Figure 7:
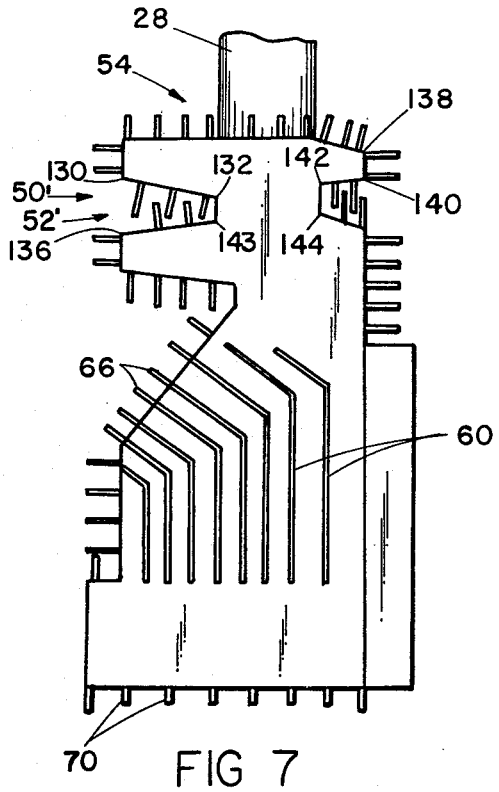
FIG. 7 is a side, elevational view of an alternative firebox in accordance with the present invention.

An alternative form of the firebox 14 and the plenum 50 illustrated in FIGS. 2–6 is shown in FIG. 7. With this alternative construction, generally designated 14', the plenum 50' has the same general vertical cross-sectional shape as the plenum 50 in the previously described embodiment. However, this alternative construction permits easier fabrication of the plenum portion from larger sheets of steel. The rear wall of the upper and lower chamber defining means 54', 52' is fabricated from a single piece of steel which is bent at crease lines 130, 132, 134 and 136. Similarly, the front wall defining plates for the chambers 54' and 52' may be fabricated from a single sheet of steel which is bent along crease lines 138, 140, 142 and 144. The firebox 14' shown in FIG. 7 is preferably fabricated with a vertically extending front wall 142. The vertical positioning of the front wall 142 helps to reduce smoking within the firebox. The rear walls and bottom walls of the firebox 14' are the same as in the previously described embodiment. Further, heat exchange fins are also provided over substantially the entire exterior surface area of the firebox 14' to increase the heat exchange surface area, the rate of heat exchange, the overall efficiency of the device and also to channel and guide the incoming forced air over, around and under the firebox 14' and the plenum 50'.

OPERATION

Figure 10:
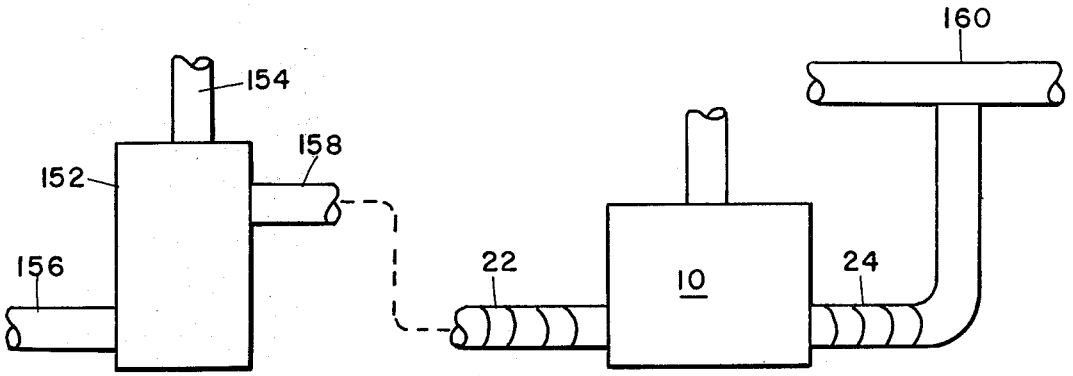
FIG. 10 is a schematic illustration showing the connection of the fireplace heat exchange unit into an existing forced air heating system.

A fireplace heating unit 10 in accordance with the present invention is connected in line with either the cold air return duct or a hot air distribution duct of a conventional, forced air heating system. As schematically shown in FIG. 10, the conventional forced air heating system would typically include an oil or gas fired furnace 152. The furnace 152 includes a chimney or flue 154, a cold air return duct 156 and a hot air duct 158. The hot air duct 158 usually conveys the heated air from the plenum of the furnace 152 to the existing distribution duct work 160. The fireplace heating unit 10 in accordance with the present invention may be placed in line with the hot air distribution duct 158 so that 100% of the forced air will pass through the enclosure 12. In the alternative, the unit 10 could be placed in line with the cold air return duct so that air heated within the enclosure 12 would then be passed to the plenum of the conventional furnace 152.

In use, the doors 16, 18 are opened and a fire is started within the hearth portion of the firebox. Once the fire is burning, the doors 16, 18 are closed and the air control means 26 and damper 90 are adjusted until sufficient air is provided to merely support combustion. The hot combustion gases produced by the burning material within the firebox will rise upwardly and directly impinge on the angled portion 38 of the rear wall of the firebox and also pass into the plenum 50. The plenum 50 will hold the hot combustion gases to retain the heat from these gases within the enclosure for a longer period of time than has heretofore been accomplished, thereby increasing the amount of heat transferred to the air within the enclosure 12. The forced air from the conventional heating system entering the enclosure 12 at the inlet duct 22 will pass over, around and under the firebox and also over and around the separate chambers or portions 52, 54 of the plenum means 50. The plenum provides a large heat exchange surface area.

In a presently existing embodiment of the invention, the overall height of the firebox to the base of the chimney is 53 inches, the depth of the firebox is 31 inches, the width of the front of the firebox is 34 inches and the width at the rear thereof is 22 inches. The portion of the chimney above the plenum has a diameter of 12 inches.

Temperatures within the chimney 28 and plenum 50 obtainable with the heating unit in accordance with the present invention are on the order of 600°–700° F. A unit in accordance with the present invention is capable of producing over 150,000 BTU/hr. Typically, 100,000 BTU/hr is required to heat a 2,000 sq/ft dwelling down to −10° F. If a unit produces only 40,000 BTU/hr continuously, it will heat the average dwelling 80% of the time. Due to the substantial increased surface are of the firebox and plenum resulting from the fins and the shape of these portions, inlet air of approximately 65° may be discharged from the enclosure at a temperature of approximately 180° F. As a result, the heat exchange unit in accordance with the present invention is capable of providing sufficient heat for an average dwelling of approximately 2,000 sq/ft. A substantially less expensive and more plentiful material such as wood may be burned in the firebox. The conventional forced air gas or oil furnace 152 may function as merely an auxiliary heating system with the main heating load carried by the fireplace unit. The unit is also aesthetically pleasing and is readily installed in new homes during construction or it may be added to existing structures with no special installation problems.

In view of the foregoing description, various modifications, which would not depart from the inventive concepts disclosed herein, will undoubtedly now become apparent to those of ordinary skill in the art. For example, the enclosure 12 may extend vertically along its rear wall as shown in FIG. 2 or, as is preferred, the rear wall may follow the contour of the firebox and plenum as shown in FIG. 6. Also, other forms of air control means 26 could be employed to control the combustion air entering the firebox. For example, a single elongated plate pivoted along one lateral edge could be provided for such air control. Therefore, it is expressly intended that the above description should be considered as that of the preferred embodiment only. The true spirit and scope of the present invention will be determined by reference to the appended claims.

The embodiments of the invention in which an exclusive property or privilege is claimed are defined as follows:

1. A fireplace heating unit within which a fuel may be burned and which is connectable to a forced air system of a building, comprising:

a housing having a front wall, sidewalls, a rear wall, a top wall and a bottom wall, said front wall having an opening therein, said housing having an inlet in one wall and an outlet in another wall;

a firebox positioned within said housing so as to define with said housing a heat exchange space, said firebox including sidewalls, a rear wall, a bottom wall, an open front and plenum means positioned on top of said firebox for defining a chamber within which combustion gases may be collected;

a plurality of heat exchange fin means on the exterior of said firebox and on said plenum means, said fin means positioned on said sidewalls, rear wall and bottom wall of said firebox to define channels through which air entering said housing inlet passes for guiding the air over and around said firebox and said plenum means through said heat exchange space and for increasing the rate of heat transfer from said firebox to said air;

closure means positioned at the open front of said firebox and the front wall opening of said housing for closing said open front and said front wall opening;

combustion air control means at said housing front wall opening for controlling the amount of combustion air entering said firebox;

chimney means connected to said firebox plenum means for directing combustion gases out of said firebox; and damper means positioned within said chimney means for controlling combustion gas flowing out of said chimney means whereby said combustion air control means and said damper means may regulate the amount of combustion air entering said firebox so that combustion is maintained and air passing from said housing inlet to said housing outlet will be heated before entering the existing forced air heating system.

2. A fireplace heating unit as defined by claim 1 wherein said heat exchange fin means on said bottom wall of said firebox extend between said sidewalls.

3. A fireplace heating unit as defined by claim 2 wherein said rear wall of said firebox includes a first portion extending vertically and a second portion angled towards the open front so as to define, with said sidewalls, a smoke dome of decreasing cross section area, said smoke dome opening into said plenum means.

4. A fireplace heating unit within which a fuel may be burned and which is connectable to a forced air system of a building, comprising:

a housing having a front wall, sidewalls, a rear wall, a top wall and a bottom wall, said front wall having an opening therein, said housing having an inlet in one wall and an outlet in another wall;

a firebox positioned within said housing so as to define with said housing a heat exchange space, said firebox including sidewalls, a rear wall, a bottom wall, an open front and plenum means positioned on top of said firebox for defining a chamber within which combustion gases may be collected;

a plurality of heat exchange fin means on the exterior of said firebox, said fin means positioned to define channels through which air entering said housing inlet passes for guiding the air over and around said firebox through said heat exchange space and for increasing the rate of heat transfer from said firebox to said air;

closure means positioned at the open front of said firebox and the front wall opening of said housing for closing said open front and said front wall opening;

combustion air control means at said housing front wall opening for controlling the amount of combustion air entering said firebox;

chimney means connected to said firebox plenum for directing combustion gases out of said firebox; and damper means positioned within said chimney means for controlling combustion gas flowing out of said chimney means whereby said combustion air control means and said damper means may regulate the amount of combustion air entering said firebox so that combustion is maintained and air passing from said housing inlet to said housing outlet will be heated before entering the existing forced air heating system, said rear wall of said firebox including a first portion extending vertically and a second portion angled towards the open front so as to define, with said sidewalls, a smoke dome of decreasing cross section area, said smoke dome opening into said plenum means, said plenum means including:

a first portion defining a first chamber connected to said smoke dome;

a vertical transfer portion having a horizontal cross-sectional area less than that of said first portion; and a second portion defining a second chamber communicating with said first chamber through said transfer portion.

5. A fireplace heating unit as defined by claim 4 wherein said damper means comprises an eccentric disc mounted within said chimney means, said disc being pivoted from a first closed position wherein only a portion of the chimney means cross-sectional area is open to a second open position wherein substantially all of the chimney of cross-sectional area is open.

6. A fireplace heating unit as defined by claim 5 wherein said damper means further includes an actuator connected to said disc and extending through said plenum and said firebox and exteriorly of said housing front wall for permitting manual positioning of said damper.

7. A fireplace heating unit as defined by claim 6 wherein said combustion air control means comprises:

a first elongated plate having a plurality of longitudinally spaced apertures therein;

a second elongated plate contacting the front face of said first plate and having a plurality of longitudinally spaced apertures therein, said first and second plates being movable relative to each other so that the overlap of said apertures of said plates may be varied.

8. A fireplace heating unit as defined by claim 7 wherein the inner surface of the walls of said housing are covered by an insulating material.

9. An improved fireplace heater connectable to a forced air system, said heater being of the type including a firebox having an access opening in the front thereof, an enclosure surrounding the firebox and defining therewith a heat exchange space, said enclosure having an inlet and an outlet on opposed sides of said firebox, a closure door secured to the front of said firebox for selectively closing off said opening and a chimney having an outlet and an inlet connected at its base to said firebox, the improvement comprising:

a plenum positioned between said chimney and said firebox for collecting combustion gases and delaying passage of said combustion gases into said chimney;

combustion air control means for controlling the amount of combustion air entering said firebox;

a chimney damper means positioned between said plenum and the outlet of said chimney for limiting the amount of combustion gases passing out said chimney; and a plurality of heat transfer increasing fins on said firebox and said plenum for increasing the rate at which the heat is transferred from said combustion gases to the air in said heat exchange space and for guiding such air around and over said firebox and said plenum and wherein said firebox includes a rear wall having an upper, forwardly angled portion connected to said plenum whereby combustion gases will directly impinge upon said wall and be directed into said plenum.

10. An improved fireplace heater connectable to a forced air system, said heater being of the type including a firebox having an access opening in the front thereof, an enclosure surrounding the firebox and defining therewith a heat exchange space, said enclosure having an inlet and an outlet on opposed sides of said firebox, a closure door secured to the front of said firebox for selectively closing off said opening and a chimney having an outlet and an inlet connected at its base to said firebox, the improvement comprising:

a plenum positioned between said chimney and said firebox for collecting combustion gases and delaying passage of said combustion gases into said chimney;

combustion air control means for controlling the amount of combustion air entering said firebox;

a chimney damper means positioned between said plenum and the outlet of said chimney for limiting the amount of combustion gases passing out said chimney; and a plurality of heat transfer increasing fins on said firebox and said plenum for increasing the rate at which the heat is transferred from said combustion gases to the air in said heat exchange space and for guiding such air around and over said firebox and said plenum and wherein said firebox includes a rear wall having an upper, forwardly angled portion connected to said plenum whereby combustion gases will directly impinge upon said wall and be directed into said plenum, said plenum defining a first collector chamber communicating directly with said firebox, a transfer tube and a second collector chamber communicating with said first chamber through said transfer tube, said first and second chambers being dimensioned larger than said transfer tube.

11. An improved fireplace heater as defined by claim 10 wherein said transfer tube extends intermediate the ends of said plenum chambers.

12. An improved fireplace heater as defined by claim 11 wherein said chimney damper means comprises:

an eccentrically pivoted disc positioned within said chimney, said disc being dimensioned so that when it is positioned transverse of the chimney, said chimney is partially open; and actuator means connected to said disc for varying the position of said disc from a position transverse to said chimney to a position extending longitudinally of said chimney.

13. An improved fireplace heater as defined by claim 12 wherein said disc is dimensioned so that when it is positioned transverse of said chimney, 10% of the cross-sectional area of the chimney is open.

* * * * *